US010633793B2

(12) United States Patent
Enqvist et al.

(10) Patent No.: US 10,633,793 B2
(45) Date of Patent: Apr. 28, 2020

(54) INDUSTRIAL TEXTILE AND USE OF THE SAME

(71) Applicant: Valmet Technologies Oy, Espoo (FI)

(72) Inventors: Rauno Enqvist, Nokia (FI); Juha Paavolainen, Kangasala (FI)

(73) Assignee: VALMET TECHNOLOGIES OY, Espoo (FI)

( * ) Notice: Subject to any disclaimer, the term of this patent is extended or adjusted under 35 U.S.C. 154(b) by 0 days.

(21) Appl. No.: 16/075,866

(22) PCT Filed: Feb. 17, 2017

(86) PCT No.: PCT/FI2017/050103
§ 371 (c)(1),
(2) Date: Aug. 6, 2018

(87) PCT Pub. No.: WO2017/144773
PCT Pub. Date: Aug. 31, 2017

(65) Prior Publication Data

US 2019/0040579 A1 Feb. 7, 2019

(30) Foreign Application Priority Data

Feb. 26, 2016 (FI) ..... 20165149

(51) Int. Cl.

| | |
|---|---|
| ***D03D 13/00*** | (2006.01) |
| ***D21F 1/00*** | (2006.01) |
| ***D03D 1/00*** | (2006.01) |
| ***D03D 15/00*** | (2006.01) |
| *D03D 11/02* | (2006.01) |
| *D21F 7/08* | (2006.01) |

(52) U.S. Cl.
CPC ..... *D21F 1/0072* (2013.01); *D03D 1/0094* (2013.01); *D03D 13/004* (2013.01); *D03D 13/008* (2013.01); *D03D 15/0088* (2013.01); *D21F 1/0027* (2013.01); *D10B 2505/04* (2013.01); *D21F 7/08* (2013.01)

(58) Field of Classification Search
CPC ..... D21F 1/0027; D21F 1/0036; D21F 7/083; D21F 7/12; D21F 7/08; D21F 5/184; D03D 1/00; D03D 1/0094; D03D 3/04; D03D 11/00; D03D 13/00; D03D 13/004; D03D 13/008; D03D 15/0088; D03D 2700/02
See application file for complete search history.

(56) References Cited

U.S. PATENT DOCUMENTS

| | | | | |
|---|---|---|---|---|
| 3,351,205 A | | 11/1967 | Butler et al. | |
| 4,290,209 A | | 9/1981 | Buchanan et al. | |
| 4,438,788 A | * | 3/1984 | Harwood | D21F 1/0036 139/383 AA |

(Continued)

FOREIGN PATENT DOCUMENTS

| | | |
|---|---|---|
| FI | 96047 | 4/1996 |
| JP | 4-504740 | 8/1992 |

(Continued)

*Primary Examiner* — Robert H Muromoto, Jr.
(74) *Attorney, Agent, or Firm* — Leason Ellis LLP

(57) ABSTRACT

An industrial fabric is formed of several machine direction (MD) yarns and several cross machine direction (CMD) yarns. The MD-yarns are twisted relative their longitudinal axis so that the twisted yarns have sloped surfaces at least on a web side surface (P) of the textile. The textile is usable in paper machine, pulp machine or filtering machine.

8 Claims, 4 Drawing Sheets

(56) References Cited

U.S. PATENT DOCUMENTS

| | | | | |
|---|---|---|---|---|
| 4,755,420 | A | 7/1988 | Baker et al. | |
| 5,089,324 | A * | 2/1992 | Jackson | D21F 1/0027 139/383 A |
| 5,092,373 | A * | 3/1992 | Lee | D21F 1/0036 139/383 AA |
| 5,148,838 | A * | 9/1992 | Lee | D21F 1/0036 139/383 AA |
| 5,230,371 | A * | 7/1993 | Lee | D21F 1/0036 139/383 A |
| 5,998,310 | A * | 12/1999 | Bowen, Jr. | D21F 1/0027 139/383 A |
| 6,742,548 | B2 * | 6/2004 | Enqvist | D21F 1/0027 139/383 A |
| 7,624,767 | B2 * | 12/2009 | Enqvist | D21F 1/0054 139/383 A |
| 8,080,136 | B2 * | 12/2011 | Enqvist | D21F 1/0036 139/383 A |
| 2003/0066935 | A1 * | 4/2003 | Enqvist | D21F 1/0027 245/5 |
| 2006/0068665 | A1 * | 3/2006 | Pernegger | B28B 1/527 442/268 |
| 2006/0085998 | A1 * | 4/2006 | Herman | D21F 5/182 34/453 |
| 2008/0142109 | A1 | 6/2008 | Herman | |
| 2008/0230139 | A1 * | 9/2008 | Enqvist | D21F 1/0054 139/383 AA |
| 2009/0159148 | A1 * | 6/2009 | Enqvist | D21F 1/0036 139/383 AA |
| 2013/0014064 | A1 | 1/2013 | Zhu et al. | |
| 2015/0211179 | A1 * | 7/2015 | Alias | D21F 1/0027 162/289 |
| 2017/0044717 | A1 * | 2/2017 | Quigley | D03D 13/00 |
| 2017/0275823 | A1 * | 9/2017 | Enqvist | D21F 1/0054 |
| 2018/0291557 | A1 * | 10/2018 | Paavolainen | D21F 7/12 |
| 2019/0003118 | A1 * | 1/2019 | Alias | D21F 1/0027 |
| 2019/0015192 | A1 * | 1/2019 | Nakazawa | D03D 15/0061 |
| 2019/0040579 | A1 * | 2/2019 | Enqvist | D03D 13/004 |

FOREIGN PATENT DOCUMENTS

| | | |
|---|---|---|
| JP | 2003336187 | 11/2003 |
| JP | 2011246834 | 12/2011 |
| KR | 10-1995-0014794 | 12/1995 |
| WO | WO 01/88260 | 11/2001 |

* cited by examiner

INDUSTRIAL TEXTILE AND USE OF THE SAME

CROSS-REFERENCE TO RELATED PATENT APPLICATIONS

This application is a U.S. National Phase Application under 35 U.S.C. § 371 of International Patent Application No. PCT/FI2017/050103, filed Feb. 17, 2017, which claims the priority of Finnish Application No. 20165149, filed Feb. 26, 2016, each of which is incorporated by reference as if expressly set forth in its entirety herein.

BACKGROUND OF THE INVENTION

The invention relates to an industrial textile, which is intended for supporting a fibre web in a processing machine. The industrial textile comprises several machine direction yarns and several cross machine direction yarns.

The invention relates also to a use of an industrial textile.

The field of the invention is defined more specifically in preambles of the independent claims.

Industrial textiles are used on web processing machines. During use dirt and fibres may adhere on surfaces of the industrial textile whereby properties of the industrial textile diminish. Thus, the industrial textiles need to be washed at intervals or continuously. However, cleaning of the surfaces and structures of the known industrial textiles has shown to contain some problems.

BRIEF DESCRIPTION OF THE INVENTION

An object of the invention is to provide a novel and improved industrial textile and use of the same.

The industrial textile of the invention is characterized by features of characterized portion of a first independent apparatus claim.

The use of the invention is characterized by features of characterized portion of a second independent apparatus claim.

An idea of the disclosed solution is that the industrial textile comprises several machine direction yarns, which are twisted relative to their longitudinal axis. The twisted flat machine direction yarns expose as slanted surfaces at least on the web side surface.

An advantage of the disclosed solution is that washing of the textile is improved since fluid sprays hitting the twisted machine direction yarns are directed further from the sloping surfaces into the structure of the textile. The web side surface of the textile does not include surfaces perpendicular to direction of the fluid sprays, but instead it contains slanted surfaces which direct the fluid sprays effectively through the textile. The structure may also allow the slanted machine direction yarns to move relative to the cross machine direction yarns thereby causing mechanical loosening of dirt. The disclosed solution may also have benefits when being applied in fluid spray cutting embodiments, as will be disclosed later in this patent application.

The slanting may be achieved by providing the textile with an excess number of MD-yarns, whereby the MD-yarns do not have enough space in the CMD-direction, wherefore the MD-yarns are forced to be slanted. This effect is achieved intentionally by including extra yarns to the structure. Alternatively, or in addition to, the textile may be shrunk in the CMD-direction whereby the flat MD-yarns have lack of transversal space causing then the MD-yarns to be slanted.

According to an embodiment, all of the machine direction yarns of the textile are twisted.

According to an embodiment, the textile comprises at least one section in cross machine direction provided with twisted flat machine direction yarns. Thus, it is possible to provide one or both cross direction edge portions with the twisted MD-yarns, or alternatively, to provide a central cross direction portion with the twisted yarns.

According to an embodiment, each of the slanted surfaces formed of the twisted flat machine direction yarns appear as portions having shape of an outer surface of a segment of a truncated circular cone at least on the web side surface of the textile, when seen from the web side surface.

According to an embodiment, the textile comprises several adjacent first machine direction yarns and second machine direction yarns which are twisted towards opposite cross machine directions. Then, first surfaces of the flat first machine direction yarns on the web side surface are slanted towards a first longitudinal edge of the textile and second surfaces of the flat second machine direction yarns are slanted towards an opposite second longitudinal edge of the textile.

According to an embodiment, when comparing adjacent cross machine directions yarns, the adjacent twisted flat machine direction yarns are twisted into opposite directions. Then, the adjacent MD-yarns expose slanted surfaces on the web side surface of the textile, which surfaces are slanted towards opposite directions in the cross machine direction.

According to an embodiment, when comparing adjacent cross machine directions yarns, the adjacent twisted flat machine direction yarns are twisted into same direction. Then, the adjacent MD-yarns expose slanted surfaces on the web side surface of the textile, which surfaces are slanted towards the same direction in the cross machine direction.

According to an embodiment, at least the web side surface of the textile comprises several grooves in the cross machine direction. The grooves are between adjacent slanted surfaces formed of the twisted flat machine direction yarns exposing at the cross machine direction yarns. The transversal grooves provide the web side surface with directed open space and allow washing liquid to be flow in the grooves. Thereby, penetration of the washing liquid through the textile may be increased. The grooves also improve effect of air drying devices whereby more efficient drying of the textile may be achieved after the washing measures. The grooves may extend in the transverse direction from edge to edge of the textile, or the grooves may have shorter length. However, length of the grooves should preferably correspond at least with width of a spraying unit of a washing device or width of a blower unit of an air drying device.

According to an embodiment, the textile is a woven fabric.

According to an embodiment, the textile is a wound structure.

According to an embodiment, the textile is a woven fabric and has a single-layer structure so that the textile has cross machine direction yarns only in one single layer. Further, the machine direction yarns have 2-shed weaving structure.

According to an embodiment, the industrial textile is a dryer fabric for a dryer section of a paper machine.

According to an embodiment, the industrial textile is a forming fabric for a forming section of a paper machine.

According to an embodiment, the industrial textile is a filter fabric or element for a filtering machine. The filtering machine may be a belt filter wherein a belt filter element comprises several twisted machine direction yarns as disclosed in this patent application.

According to an embodiment, the industrial textile is a pulp supporting fabric or textile for a pulp machine.

According to an embodiment, the industrial textile is a pulp supporting fabric or textile for a pulp machine and the supporting fabric is configured to intentionally generate marking to a surface of a fibre web supported on the supporting fabric. Thus, the supporting fabric may generate topography to a bottom surface of the fibre web for increasing friction. The increased friction may improve running properties and controllability of the supporting fabric.

According to an embodiment, the textile has a symmetrical structure.

According to an embodiment, the web side surface and the roll side surface of the textile are identical and have the same surface properties.

According to an embodiment, the textile has high number of contact points and also extremely low surface contact area. Combination of these two features in the same textile makes it unique. The textile has at least 60 contact points per square centimeter, preferably at least 64 contact points per square centimeter. The high number of contact points improves heat transfer and avoids marking since the web is well supported. It has been noted, that textiles having low surface contact area are easier to wash. Therefore, the surface contact area of the textile may be between 10-20%. Further, the web side surface of the textile may be treated or finished so that the surface contact area increases from an initial value. The web side surface may be polished or pressed, for example. The treatment does not influence to the number of contact points.

According to an embodiment, the textile has high number of contact points and relatively large surface contact area. This kind of textile may be used in special applications in a conventional manner. In this embodiment the number of the contact points may be as disclosed in the previous embodiment and the surface contact area of the textile may be 50% or more.

According to an embodiment, thickness of the textile is less than 1.4 mm, preferably 1.3 mm. When an effective caliper of the industrial textile is small washing and drying of the textile are facilitated.

According to an embodiment, the machine direction yarns are monofilament yarns. Further, cross section of the machine direction yarns may be rectangular or substantially rectangular. Width of the machine direction yarn may be 0.6 mm or more and height 0.4 mm or less.

According to an embodiment, cross section of the cross machine direction yarns is round. The round CMD-yarns are advantageous since washing fluid flows inside the textile structure be effectively directed by curved surfaces of the round yarns. Thereby, the round yarns may have positive impact on washing of the textile. Furthermore, the round CMD-yarns may allow flat MD-yarns to slightly move relative to the CMD-yarns, whereby also mechanical dirt removal may occur.

According to an embodiment, dimensions of adjacent cross direction machine yarns are substantially similar.

According to an embodiment, dimensions of adjacent cross direction machine yarns differ from each other. This way, web side surface of the textile may have a relatively coarse structure. The coarse surface may comprise free voids, which facilitates washing of the textile.

According to an embodiment, the cross machine direction yarns are strongly shrinking yarns, whereby heat treatment of the textile is configured to cause cross direction shrinkage of the textile so that adjacent machine direction yarns are being moved closer to one another. The shrinking may cause the twisting of the MD-yarns.

According to an embodiment, machine direction yarn density is 220-230 1/10 cm. Further, warp cover may be even 180%, which is an extremely high value for at least in one single layer of the textile. The textile may comprise only one single layer, or alternatively, the textile may comprise a support base on which is wound the twisted MD-yarns.

According to an embodiment, cross direction machine yarn density is 60 1/10 cm.

According to an embodiment, the industrial textile disclosed above may be utilized in processing machines containing at least one water or fluid cutting device for cutting one or more edge portions of a web supported on the textile. The textile comprises twisted MD-yarns in accordance with the above disclosed principles. At least at the edge portion subjected to the high cutting fluid spray is provided with the twisted MD-yarns, or alternatively, all the MD-yarns may be twisted. Since the twisted MD-yarns comprise slanted surfaces facing towards the cutting spray, the twisted yarns are not split or otherwise damaged because of the high fluid spray. Furthermore, the cutting water, after being penetrated through the web, is directed fluently through the supporting textile having slanted yarns and sufficient open voids. Therefore, the cutting water is not splashed. Thanks to this embodiment, spray cutting may be executed effectively and the cut edge has good quality.

The above disclosed embodiments may be combined in order to form suitable solutions provided with necessary features.

BRIEF DESCRIPTION OF THE FIGURES

Some embodiments are described in more detail in the accompanying drawings, in which.

For the sake of clarity, the figures show some embodiments of the disclosed solution in a simplified manner. In the figures, like reference numerals identify like elements.

DETAILED DESCRIPTION OF SOME EMBODIMENTS

Figure 1:
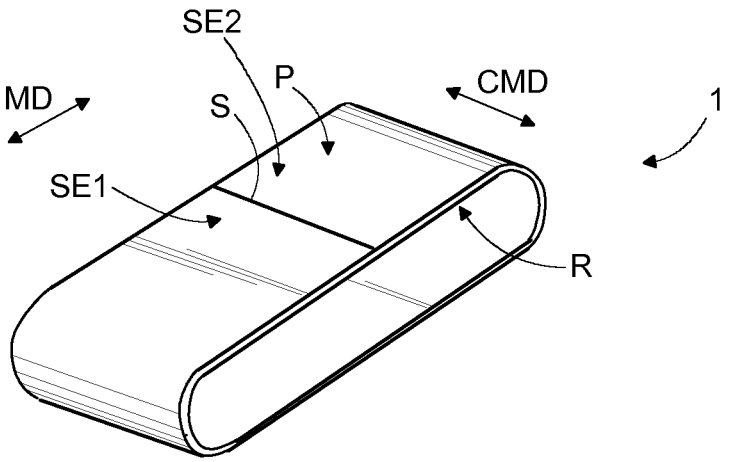
FIG. 1 is a schematic perspective view of an industrial textile provided with a seam and thereby having a shape of an endless loop.

FIG. 1 shows some basic features of a feasible industrial textile 1. The industrial textile 1 may be a woven structure comprising machine direction yarns 2 and cross machine direction yarns 3, which are crossing each other. The industrial textile may be a fabric, which is flat woven and its seam ends SE1 and SE2 may be connected to each other for forming a seam S when installed on a web processing machine. The industrial textile 1 is configured to run in the machine direction MD. The industrial textile 1 comprises a web side surface P against which a web to be processed is arranged on the processing machine. An opposite side is a roll side surface which is against rolls and other machine elements of the processing machine.

Figure 2:
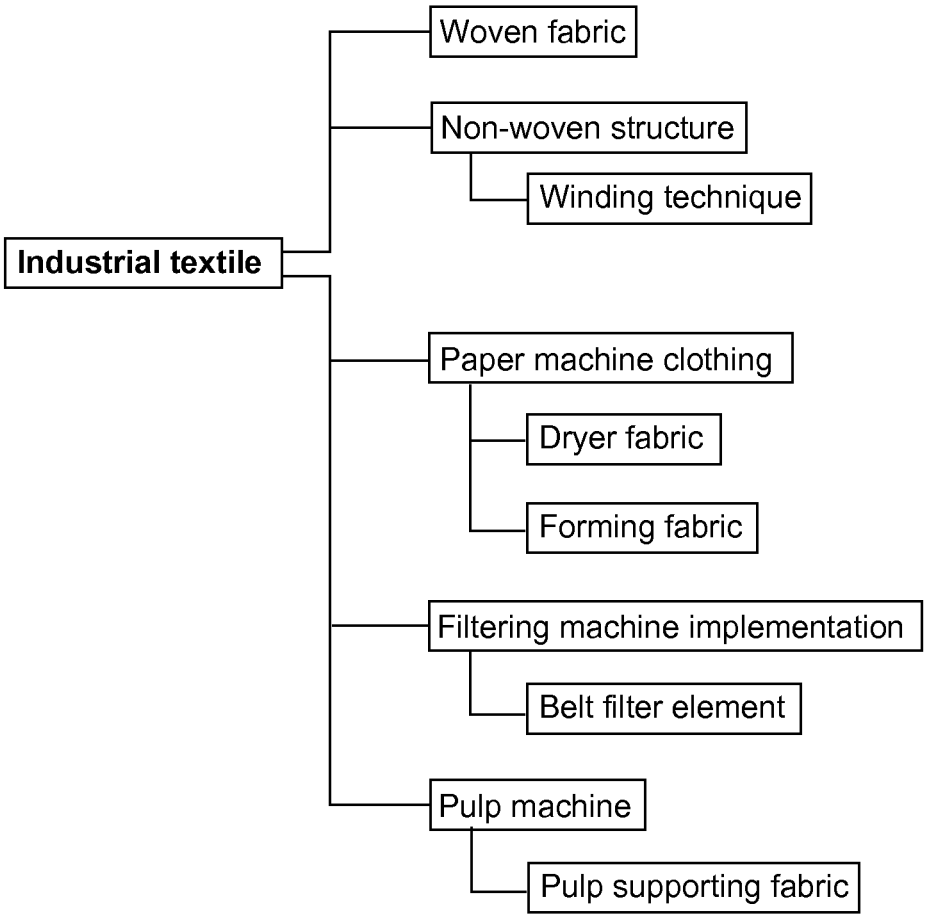
FIG. 2 shows schematically a diagram presenting some features of an industrial textile.

FIG. 2 is a diagram showing that an industrial textile may be formed by weaving, or alternatively, it may be formed by utilizing non-woven technology, such as winding. FIG. 2 also indicates that industrial textiles are used in different web processing machines, such as paper machines, filtering machines and pulp machines.

Figure 3:
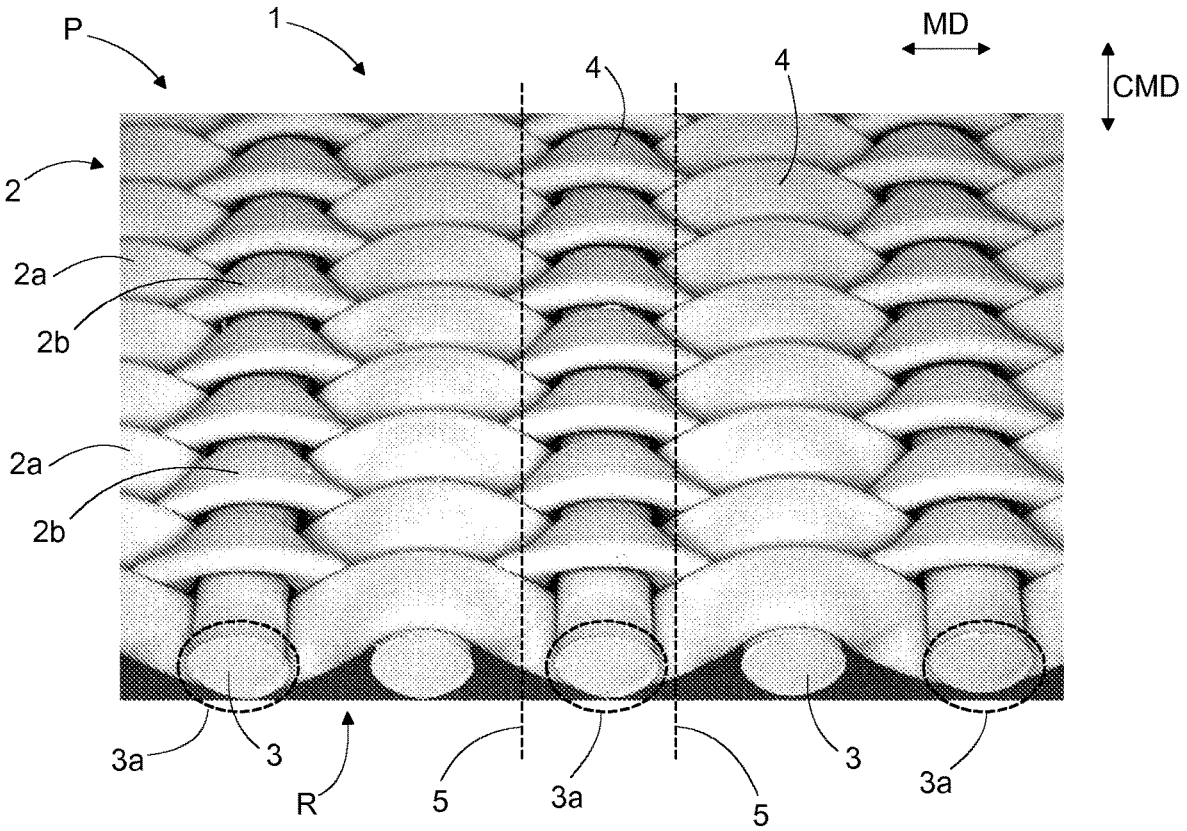
FIG. 3 is a schematic view of a web side surface of an industrial textile.

FIG. 3 shows a web side surface P of an industrial textile 1. The textile 1 comprises several flat machine direction yarns 2 and several cross machine direction yarns 3. Cross section of the machine direction yarns 2 may be substantially rectangular and cross section of the cross machine direction yarns 3 may be round. The machine direction yarns 2 are twisted relative to their longitudinal axis whereby they expose as slanted surfaces 4 on the web side surface P. As can be noted adjacent first MD-yarns 2*a* and second MD-yarns 2*b* are twisted towards opposite cross machine directions. Thereby, the web side surface comprises slanted first surfaces of the flat first machine direction yarns 2*a* and slanted second surfaces of the flat second machine direction yarns 2*b*. Between the slanted surfaces 4 directed to opposite directions are cross machine direction grooves 5, which are indicated in FIG. 3 by means of broken lines.

All the CMD-yarns may be similar yarns and may have the same cross sectional areas. Alternatively, it is possible to use two types of CMD-yarns having different cross sectional areas and/or cross sectional shapes in order to provide the surfaces of the textile 1 even more open structure. In FIG. 3 it is shown by means of broken lines 3*a* larger CMD-yarns, which alternate with smaller CMD-yarns 3. Alternatively, CMD-yarns having round cross section and CMD-yarns having flat cross sections may alternate in the textile structure for increasing free voids on the surface.

Further, the above disclosed issues may be applied also for the MD-yarns, whereby cross sectional areas and/or cross sectional shapes of the flat MD-yarns may vary in order to increase open surface of the textile. Thus, dimensions of the adjacent flat and twisted MD-yarns may be different in special cases, as well as cross sectional shapes may vary.

FIG. 3 further discloses that the industrial textile may have a weaving pattern, wherein the MD-yarns 2 pass above one CMD-yarn yarn 3, pass below one adjacent CMD-yarn and repeat this two-shed pattern further. This way, the disclosed industrial textile 1 may have a symmetrical one layer structure wherein the twisted MD-yarns 2 expose as slanted surfaces 4 on both surfaces of the textile. Thereby, the roll side surface R may also comprise transversal grooves 5. When both surfaces are provided with the grooves, flow of washing liquid through the textile structure may be increased and washing result improved.

Figure 4:
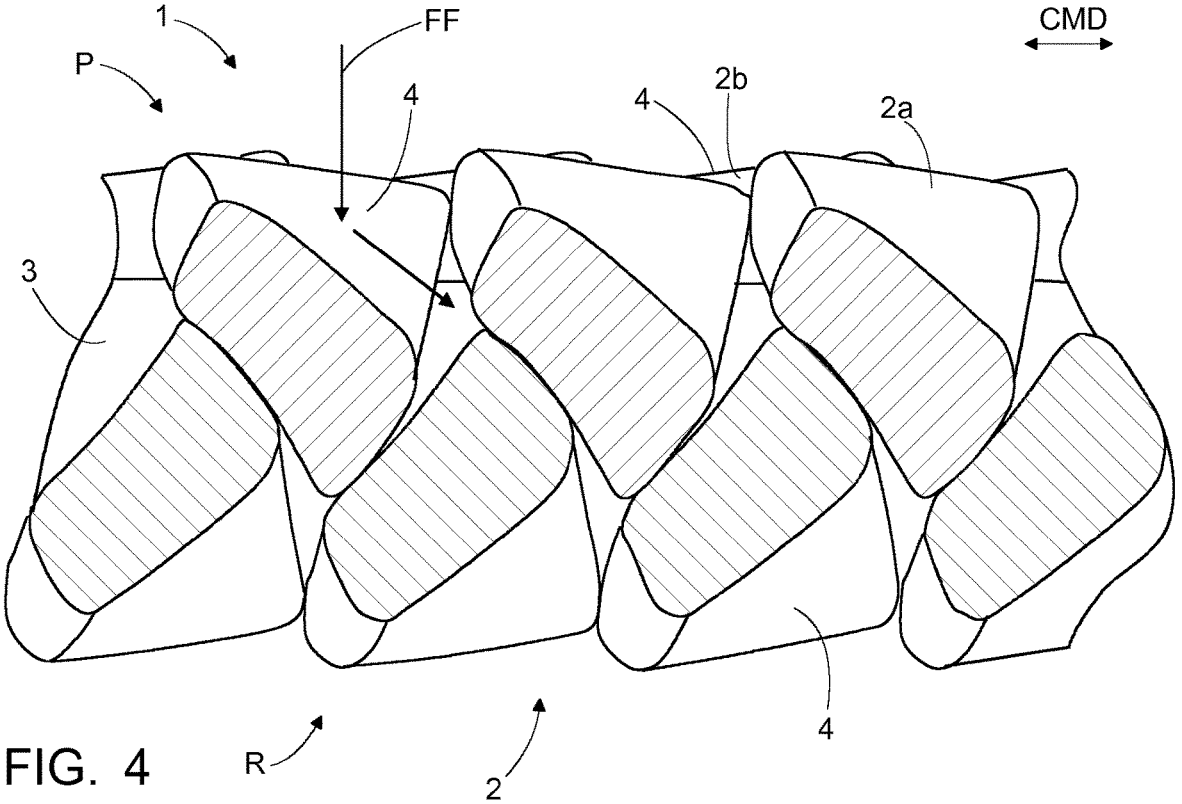
FIG. 4 is a schematic cross sectional view of an industrial textile seen in a machine direction.

FIG. 4 shows that an industrial fabric comprises slanted surfaces 4 on a web side surface P as well as on a roll side surface R. Machine direction yarns 2 are twisted relative to their longitudinal axis as can be clearly seen from FIG. 4. The structure comprises twisted first MD-yarns 2*a* and twisted second MD-yarns 2*b* twisting direction of which yarns are opposite to each other. Thus, the differently slanted surfaces 4 of the MD-yarns 2*a*, 2*b* alternate on the surfaces P, R of the textile 1. When a washing liquid flow or flushing flow FF with high pressure is directed against the web side surface of the textile 1 the flow is directed from the slanted surfaces 4 of the MD-yarns 2*a*, 2*b* towards an inner structure of the textile, and is not splashed randomly away from the surface P. After the liquid washing step, the textile may be dried by directing a dryer air flow against the web side surface P. The slanted surfaces 4 direct also the air flow through the textile structure. Thanks to the slanted surfaces 4, washing energy contained in the liquid and air flows is more effectively utilized for removing accumulated dirt and fibers from the textile structure. Thus, properties of the industrial textile may be recovered and operational life of the textile may be longer than in known solutions. Further, since the washing energy is directed effectively through the textile, lower pressures may be used in washing liquid sprays. Washing units with lower pressures (300 bar) are more reliable and less inexpensive compared to washing units generating extremely high pressures (500-600 bar). An additional advantage is that washing water jets having lower pressures do not damage structures of the yarns 2, 3 of the textile 1.

Figure 5:
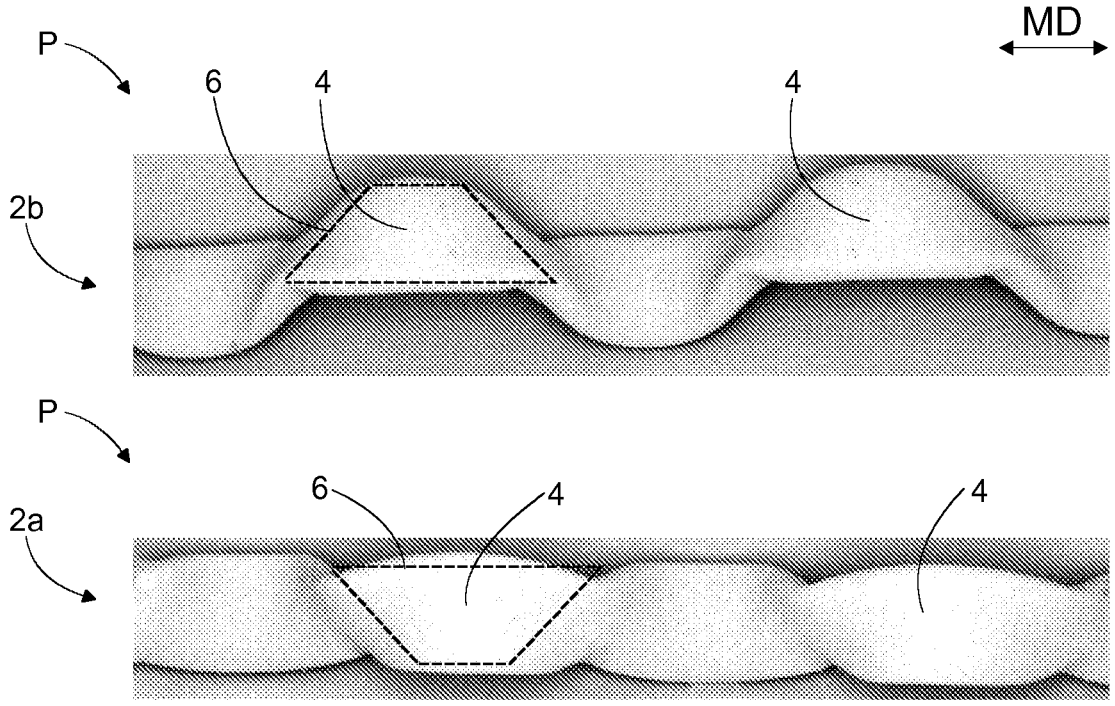
FIG. 5 is a schematic top view showing two adjacent machine direction yarns of an industrial textile.

FIG. 5 shows two adjacent machine direction yarns 2*a*, 2*b* of an industrial textile 1. The MD-yarns 2*a*, 2*b* are twisted into opposite directions whereby their slanted surfaces 4 on the web side surface P are also directed to different directions. Further, the slanted surfaces 4 formed of the twisted flat machine direction yarns appear as portions having shape of an outer surface of a segment of a truncated circular cone 6, which shape is indicated by broken lines.

Figure 6:
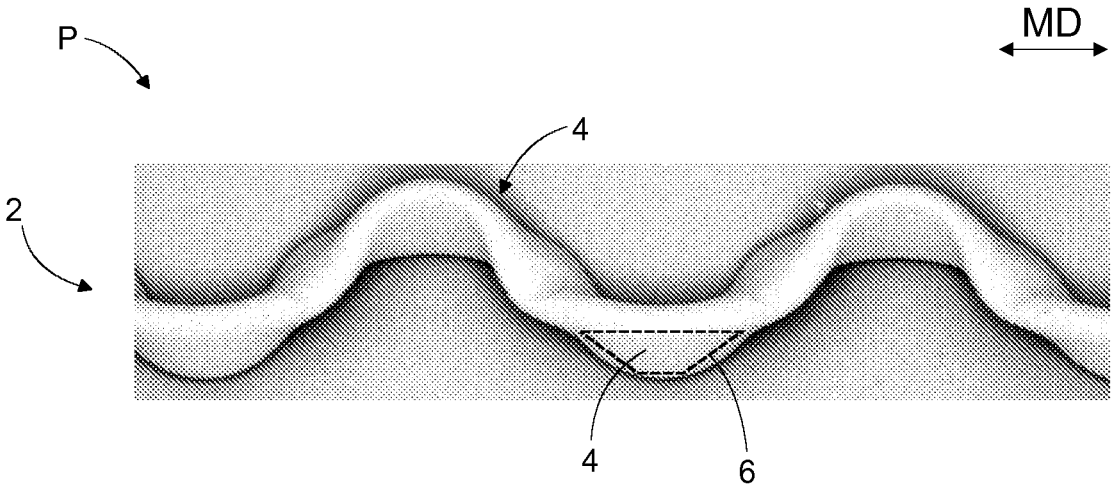
FIG. 6 is a schematic side view of a machine direction yarn of an industrial textile.

FIG. 6 is a side view of a machine direction yarn 2. The MD-yarn 2 has been permanently deformed by weaving forces or other manufacturing forces of the textile, and possibly, also by means of transverse forces caused by strong shrinkage of CMD-yarns.

Figure 7:
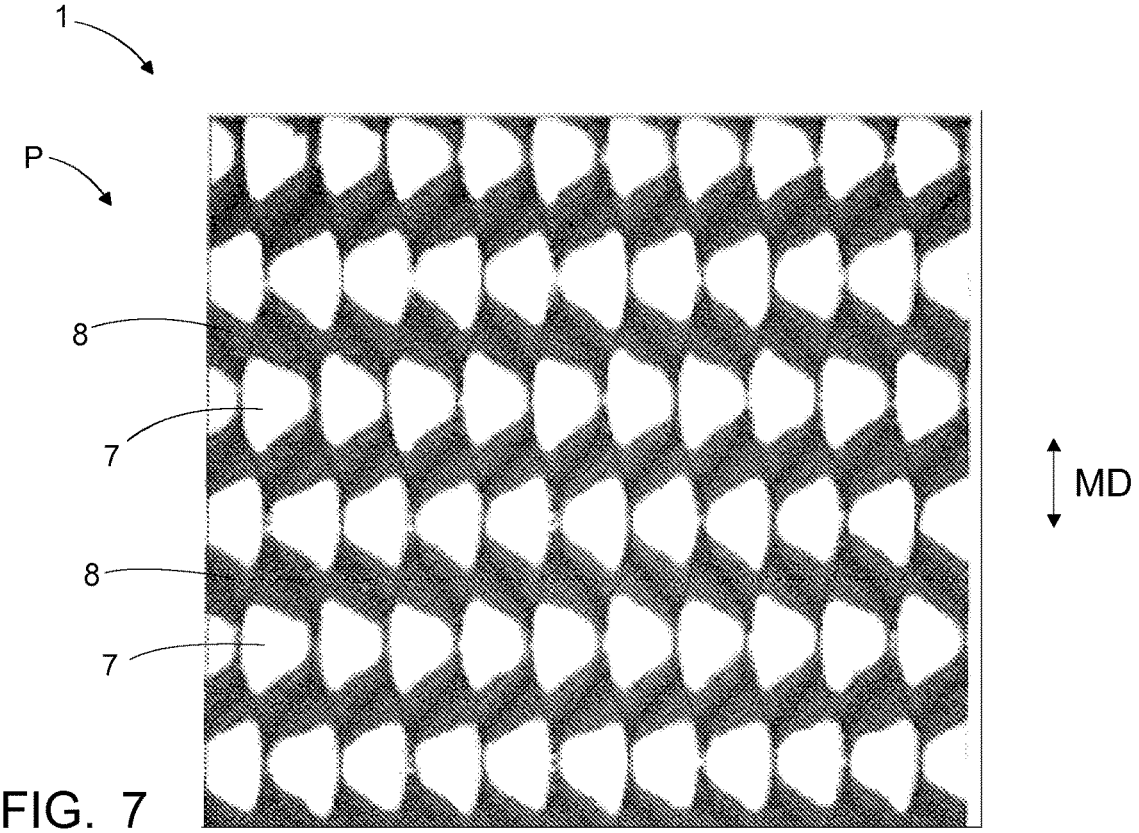
FIGS. 7 and 8 are schematic top views of surface topographies of web side surfaces of two industrial textiles.
Figure 8:
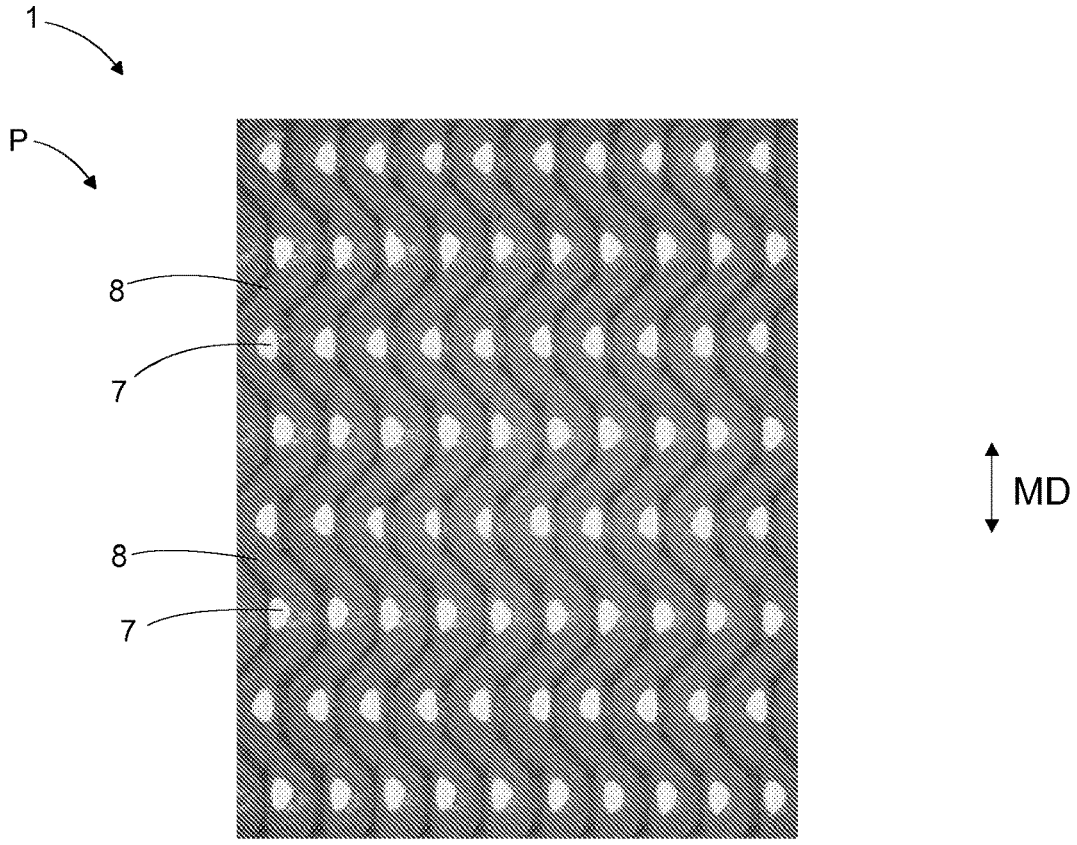

FIGS. 7 and 8 are schematic top views of surface topographies of web side surfaces P of two industrial textiles 1. Potential surface contact points and surface areas are shown in the FIGS. 7 and 8 by using lighter colour whereas darker colour indicates non contacting areas i.e. void volume 8 on the surface. It can be noted from FIG. 7, that the contact areas represent about 50% of the total surface of the industrial textile 1. In FIG. 8 the industrial fabric 1 has about 10% surface contact area. In both embodiments number of contact points is very high and still the surface contact area is low.

The drawings and the specification associated thereto is merely intended to illustrate the idea of the invention. The details of the invention may vary within the scope of the claims.

The invention claimed is:

1. An industrial textile for supporting a fibre web in a processing machine, the textile (1) comprising:

a web side surface (P), which is facing towards the fibre web to be processed during use of the industrial textile;

a roll side surface (R), which is facing towards the processing machine during the use;

several machine direction (MD) yarns (2) and at least some of them have flat cross sections; and several cross machine direction (CMD) yarns (3);

wherein the textile (1) is a woven fabric and comprises several flat machine direction yarns (2, 2*a*, 2*b*), which are twisted relative to their longitudinal axis so that each of the twisted flat machine direction yarns (2, 2*a*, 2*b*) expose as sequential slanted surfaces (4) at least on the web side surface (P).

2. The textile as claimed in claim 1, wherein all of the machine direction yarns (2) are twisted.

3. The textile as claimed in claim 1, wherein each of the slanted surfaces (4) formed of the twisted flat machine direction yarns (2) appear as portions having shape of an outer surface of a segment of a truncated circular cone (6) at least on the web side surface (P) of the textile (1) when seen from the web side surface (P).

4. The textile as claimed in claim 1, wherein the textile (1) comprises several adjacent first machine direction yarns (2*a*) and second machine direction yarns (2*b*) which are twisted towards opposite cross machine directions (CMD), whereby first surfaces (4) of the flat first machine direction yarns (2*a*) on the web side surface (P) are slanted towards a first longitudinal edge of the textile (1) and second surfaces (4) of the flat second machine direction yarns (2*b*) are slanted towards an opposite second longitudinal edge of the textile (1).

5. The textile as claimed in claim 1, wherein at least the web side surface (P) of the textile (1) comprises grooves (5) in the cross machine direction (CMD), the grooves (5) being between adjacent slanted surfaces (4) formed of the twisted flat machine direction yarns (2*a*, 2*b*) exposing at the cross machine direction yarns (3).

6. The textile as claimed in claim 1, wherein the textile (1) is a dryer fabric for a dryer section of a paper machine.

7. The textile as claimed in claim 1, wherein the textile (1) is a pulp supporting fabric for a pulp machine.

8. An industrial textile for supporting a fibre web in a processing machine, the textile (1) comprising:

a web side surface (P), which is facing towards the fibre web to be processed during use of the industrial textile;

a roll side surface (R), which is facing towards the processing machine during the use;

the textile is a woven fabric which comprises several machine direction (MD) yarns (2) and at least some of them have flat cross sections; and several cross machine direction (CMD) yarns (3) only in one single layer;

the woven fabric has a weaving pattern wherein a machine direction yarn repeatedly passes above one cross machine direction yarn and passes below one adjacent cross machine direction yarn, the machine direction yarns next to each other being arranged in such a manner that when a coincidentally selected machine direction yarn is under a cross machine direction yarn a machine direction yarn next to the coincidentally selected machine direction yarn is above the cross machine direction yarn;

wherein the woven fabric comprises several flat machine direction yarns (2, 2*a*, 2*b*), which are twisted relative to their longitudinal axis so that each of the twisted flat machine direction yarns (2, 2*a*, 2*b*) expose as sequential slanted surfaces (4) at least on the web side surface (P).

* * * * *